US006941986B2

(12) United States Patent
Hoeppner

(10) Patent No.: US 6,941,986 B2
(45) Date of Patent: Sep. 13, 2005

(54) DEVICE FOR ASEPTICALLY FILLING CONTAINERS

(75) Inventor: Dave Hoeppner, Coarsegold, CA (US)

(73) Assignee: Fmc Technologies Italia S.p.A., Parma (IT)

( * ) Notice: Subject to any disclaimer, the term of this patent is extended or adjusted under 35 U.S.C. 154(b) by 13 days.

(21) Appl. No.: 10/406,850

(22) Filed: Apr. 4, 2003

(65) Prior Publication Data

US 2004/0200188 A1 Oct. 14, 2004

(30) Foreign Application Priority Data

Feb. 4, 2003 (IT) ..... MI2003A0180

(51) Int. Cl.[7] ..... B65B 1/04
(52) U.S. Cl. ..... 141/329; 141/301
(58) Field of Search ..... 141/329, 330, 141/301, 302, 258–262, 89–92

(56) References Cited

U.S. PATENT DOCUMENTS 1,847,189 A * 3/1932 Lindstrom ..... 141/66
3,926,229 A * 12/1975 Scholle ..... 141/1
4,388,591 A * 6/1983 Lannan ..... 324/754
4,494,363 A 1/1985 Rica et al.
6,378,573 B2 * 4/2002 Schwartz ..... 141/114

* cited by examiner

*Primary Examiner*—Steven O. Douglas
(74) *Attorney, Agent, or Firm*—Lucas & Mercanti, LLP

(57) ABSTRACT

A device for aseptically filling sterile containers provided with a mouth closed by a frangible membrane, comprising actuators (K) carrying a fill group provided at its distal end with cutting means (T) and valve means and at its proximal end with means (Y) for driving the valve means. The valve means consist of a fill tube (R) closed by a conical bottom (U), externally provided with an elastomeric plug (P), and having one or more lateral slots (A) at the bottom (U), the fill tube (R) being slidably arranged within an external guide tube (E) suitable to abut on the container mouth, upon cutting of the membrane, and with which the plug (P) achieves a seal.

12 Claims, 2 Drawing Sheets

DEVICE FOR ASEPTICALLY FILLING CONTAINERS

This patent application claims a benefit of priority from Italian Patent Application No. MI2003A 000180 filed Feb. 04, 2003, the contents of which is incorporated herein by reference.

BACKGROUND OF THE INVENTION

The present invention relates to apparatuses used in the food industry for aseptically filling containers, and in particular to a device which carries out the actual container filling step.

In said industry apparatuses are already known which are used for aseptically filling containers which are supplied already sterile and provided with a mouth closed by a frangible membrane, as well as with a relevant lid. In order to maintain the sterile condition of the container, so as to guarantee the optimal storage of the product stored therein, the known apparatus includes a sterilization chamber in which the container mouth is locked and sterilized, together with the lid which will be heat sealed on said mouth after the filling. The description of such an apparatus can be found in U.S. Pat. No. 4,494,363, to which reference is made for further details.

The actual filling step is carried out through a fill tube, sterilized in turn, which is lowered into said sterilization chamber and performs a double task. First of all the tube carries at its distal end a pointed member which ruptures the sealing membrane of the sterile container. Whereafter, once the tube has entered the container and abuts on the mouth with a tapered end portion, there is opened a valve also located at the tube end through which the container is filled with the product.

OBJECTS OF THE INVENTION

The present invention exactly aims at improving the device which carries out this step, and more specifically the valve system for delivering the product. In fact in the above-mentioned patent the valve consists of an abutting shutter shaped as an "inverted pear" and carried by a stem located inside the fill tube. The pointed bottom portion of said shutter performs the membrane rupture function, while the rounded top portion performs the seal function at a corresponding seat formed in the tube end.

However the presence of the stem and shutter implies some drawbacks, since it results in a significant decrease in the diameter of the cross-section available for the passage of product in the fill tube, as well as in a tube outlet partially obstructed by the shutter even when the latter is in the open state.

The first of these drawbacks is particularly serious in the case of fluids containing particulates (e.g. fruit cut into pieces or slices), since it implies a limitation of the size of the particulates, as well as risks of clogging of the tube and/or damage of the product.

Moreover also the second drawback is more serious in such a case, since the pieces of particulate coming out of the tube can be damaged by the impact on the shutter. It should be considered, in fact, that for a more delicate filling of the container the latter is preferably flexible and arranged on a platform which keeps the bottom thereof close to the tube end and then lowers it as the filling proceeds.

Another disadvantageous aspect stemming from said drawbacks is given by the backpressure generated in the product feed circuit, which can in turn be a cause of damage to the product.

Therefore the object of the present invention is to provide a fill device which overcomes the above-mentioned drawbacks.

SUMMARY OF THE INVENTION

This object is achieved by means of a device in which the valve means are without stem and shutter. Other advantageous features are disclosed in the dependent claims.

The main advantage of the new device is therefore the possibility of having a fill tube with a free diameter comparable with the inner diameter of the container mouth, without forming obstacles whatsoever. This allows to use the device for products containing pieces of considerable size, with no risks of damage or clogging.

Moreover, a second advantage is given by the lower backpressure of the system thanks to the increased passage cross-section for the product, which in turn reduces the stress on the product and the subsequent risk of damage.

Further advantages are found in the filling of containers with highly viscous products, in terms of greater flow rate and less backpressure.

BRIEF DESCRIPTION OF THE DRAWINGS

These and other and characteristics of the device according to the present invention will be clear to those skilled in the art from the following detailed description of two embodiments thereof, with reference to the annexed drawings wherein.

DESCRIPTION OF A PREFERRED EMBODIMENT

Figure 1:
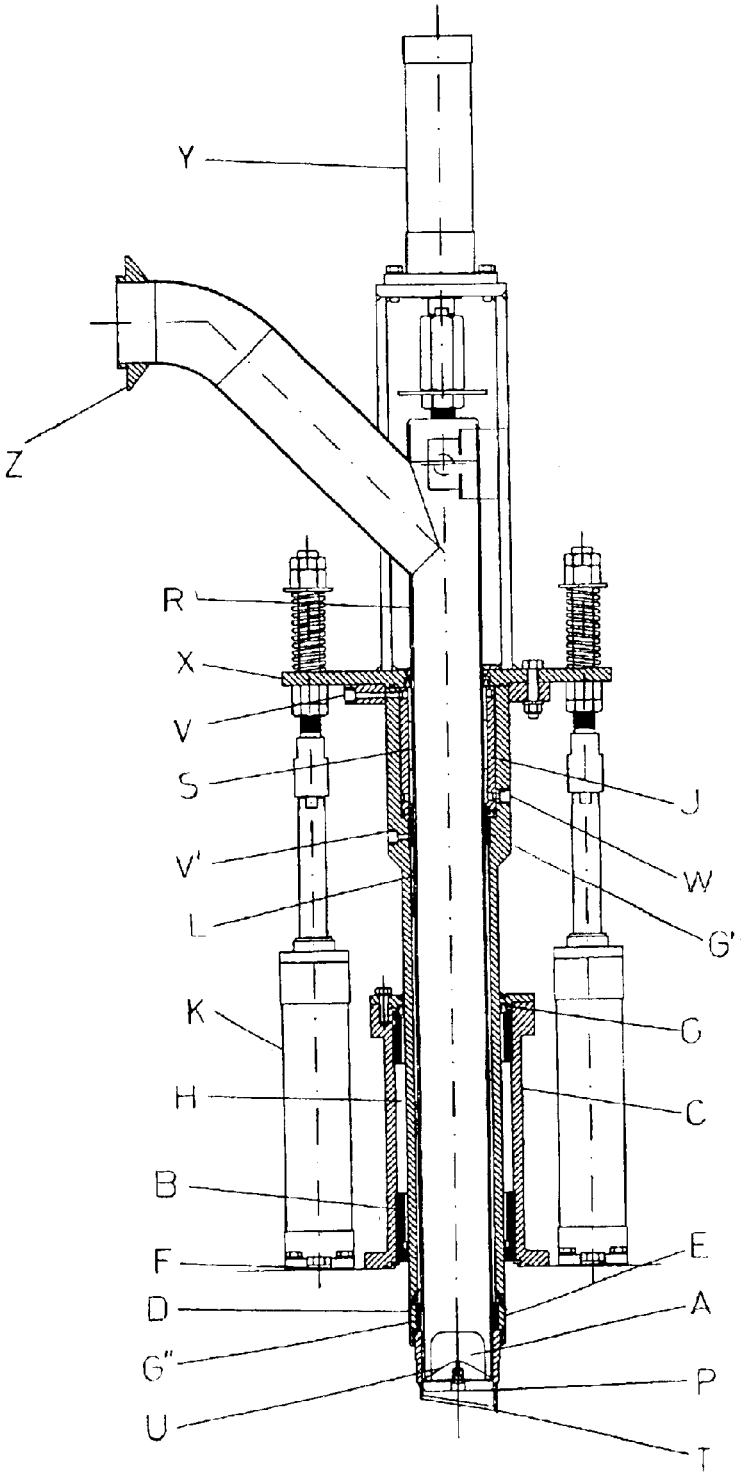
FIG. 1 is a vertical sectional view of a first embodiment of a fill device according to the invention.

With reference to FIG. 1, there is seen that a first embodiment of a filling device according to the invention conventionally includes a structure for supporting and moving the fill tube essentially consisting of a flange F, which separates the aseptic portion from the atmosphere, carrying a pair of hydraulic cylinders K on which there is secured a plate X which in turn carries the fill tube R, to which the product arrives through an inlet Z.

As mentioned above, the novel aspect of the present device is the absence of the stem inside the fill tube R as well as of the shutter at the end of the latter. More specifically, the end of the fill tube R is closed by a conical bottom U externally provided with an elastomeric plug P, and the delivery of the product takes place through a plurality of equally spaced lateral slots A, three in the illustrated example, formed at the conical bottom U whose shape is exactly intended to deflect the product toward said slots A.

The opening and closing of the slots A is achieved through a hydraulic cylinder Y, mounted on plate X, which slides the fill tube R within an external guide tube E, also mounted on plate X, with which plug P achieves a seal. The external tube E slides in turn, guided by bushings B, within a support column C mounted on flange F, and is provided at the end with a slanted cutting edge T suitable to cut the sealing membrane of the sterile container.

To sterilize the various parts of the device which enter the aseptic portions there are provided three steam sterilization areas, one for the external tube E and two for the fill tube R. A first area H is formed within the support column C, which outside the bushings B is provided with gaskets G achieving a seal, so as to sterilize the portion of the external tube E entering from outside.

The external tube E encloses in turn an upper area and a lower area for sterilizing the fill tube R. More precisely, in the area adjacent plate X, between tubes E, R there is provided a jacket J defining an upper area S in which steam enters through a top inlet V and condensate goes out through a bottom outlet W. In this way the portion of the fill tube R entering the external tube E from outside is sterilized.

This upper area S is separated by a bottom gasket G' from an underlying area L which is provided in turn with a steam inlet V' and a plurality of condensate outlets D, four in the illustrated example, formed at the lower end of tube E, where a further gasket G" achieves the sealing with respect to the product delivery area. Area L actually serves not only to sterilize the fill tube R but also to wash the valve area with sterile condensate.

In the light of the description above the operation of the present device, which operates much as the filling device of known apparatuses, is readily understood.

In a first step, the whole fill group carried by plate X is lowered by cylinders K until the cutting edge T ruptures the membrane of the container and the external tube E abuts on the mouth of the latter. Whereafter, the opening of the valve for the product delivery is caused by the lowering of the fill tube R, which slides within the external tube E driven by the hydraulic cylinder Y until the lateral slots A are uncovered.

Therefore it is clear how the device according to the present invention carries out an operative sequence similar to that of the known device and thus can be advantageously applied also as retro fit of existing apparatuses. In fact the rupture of the container membrane is now performed by edge T of the external tube E rather than by the shutter point, and cylinder Y acts on the fill tube R rather than on the shutter stem.

Figure 2:
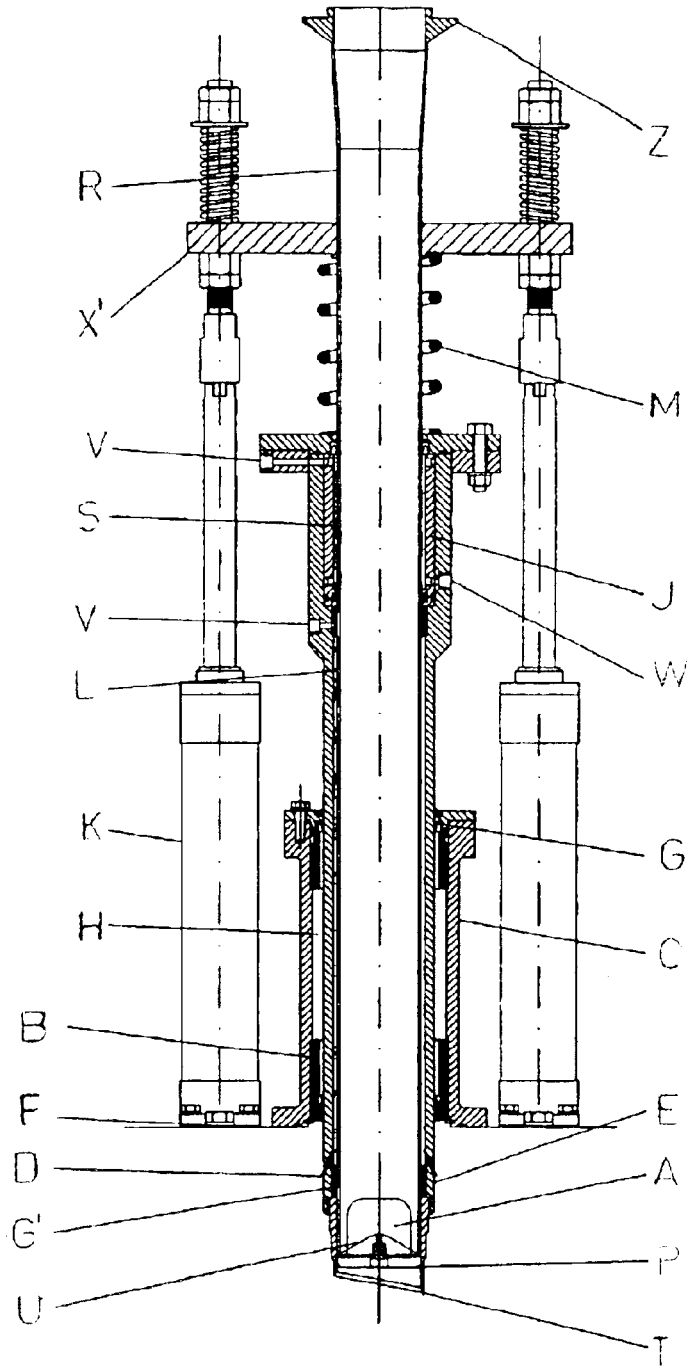
FIG. 2 is a view similar to the preceding one of a second embodiment which is different in the means for actuating the valve means.

In the second embodiment illustrated in FIG. 2, in which the same reference letters indicated the same members, the valve driving mechanism is simplified in that there is no cylinder Y but a simple spring M. More specifically, in this case the cylinders K carry a plate X' integral with tube R, while the external tube E is connected to said plate X' through a coil spring M arranged on tube R. Said spring M is selected of such a strength as not to undergo a significant compression upon cutting of the membrane.

The operation of the simplified structure above remains unchanged in the first step of fill group lowering and container membrane cutting; after the external tube E has reached abutment, the further movement of cylinders K causes however the compression of spring M and therefore the sliding of the fill tube R which results in the valve opening.

This second embodiment does not allow the same level of control of the gradualness of the valve opening as with cylinder Y, but its simplified structure has advantages in terms of cost and reliability.

It is clear that the above-described and illustrated embodiments of the device according to the invention are just examples susceptible of various modifications. In particular, the number, shape and arrangement of slots A can be freely changed according to needs, as well as the cutting member which can be different from the slanted edge T, for example a point on the lower side of plug P. Similarly, the hydraulic cylinders K and Y can be replaced by other mechanically equivalent actuators, and the same applies to spring M and to all the connection and support members, as well as to steam which can be replaced by another suitable sterilizing fluid.

Therefore, possible additions and/or modifications may be made to the device of the present invention, yet without departing from the scope of protection of the invention.

What is claimed is:

1. Device for aseptically filling sterile containers provided with a mouth closed by a frangible membrane, said device being divided into aseptic portions and portions open to the atomosphere and comprising actuator means carrying a fill group provided at its distal end with cutting means and valve means and at its proximal end with means for driving said valve means, and further comprising areas for the sterilization of the parts of said fill group entering the aseptic portions of said device, characterized in that said valve means consist of a fill tube (R) closed by a bottom (U), externally provided with an elastomeric plug (P), and having one or more lateral slots (A) at said bottom (U), said fill tube (R) being slidably arranged within an external guide tube (E) suitable to abut on the container mouth, upon cutting of said membrane, and with which said plug (P) achieves a seal.

2. Filling device according to claim 1, characterized in that the bottom (U) has a conical shape.

3. Filling device according to claim 1, characterized in that the cutting means consist of a slanted cutting edge (T) at the end of the external tube (E).

4. Filling device according to claim 1, characterized in that the external tube (E) slides within a support column (C), in which there is formed a first sterilization area (H) between end gaskets (G) which achieve the sealing of said column (C).

5. Filling device according to claim 1, characterized in that in the upper portion of the external tube (E) between the latter and the fill tube (R) there is provided a jacket (J) defining a second sterilization area (S) provided with a top inlet (V), a bottom outlet (W) and a bottom gasket (G').

6. Filling device according to claim 1, characterized in that in the central and lower portion of the external tube (E), between the latter and the fill tube (R), there is defined a third sterilization area (L) provided with a top inlet (V'), one or more bottom outlets (D) and a bottom gasket (G"), said area (L) being also suitable to perform the washing of the valve.

7. Filling device according to claim 1, characterized in that the sterilization and/or washing take place by means of steam and/or sterile condensate.

8. Filling device according to claim 1, characterized in that the fill tube (R) is slidably mounted with respect to a plate (X) connected to the actuator means on which plate the external tube (E) is secured, the driving means for the valve means consisting of an actuator which is in turn secured on said plate (X) and connected to the fill tube (R).

9. Filling device according to the preceding claim 8, characterized in that said actuator is a hydraulic cylinder (Y) aligned with the fill tube (R).

10. Filling device according to claim 1, characterized in that the fill tube (R) is secured on a plate (X') connected to the actuator means, the external tube (E) being connected to said plate (X') through a resilient member having a strength such that it does not undergo a significant compression upon cutting of the membrane, the driving means for the valve means consisting of the same above-mentioned actuator means suitable to compress said resilient member when the external tube (E) is in abutment on the container mouth.

11. Filling device according to claim 10, characterized in that said resilient member is a coil spring (M) arranged on the fill tube (R).

12. Filling device according to claim 1, characterized in that the actuator means carrying the fill group are hydraulic cylinders (K).

* * * * *